US008930164B2

(12) United States Patent
Howell

(10) Patent No.: US 8,930,164 B2
(45) Date of Patent: Jan. 6, 2015

(54) RACE TIMING SYSTEM WITH VERTICALLY POSITIONED ANTENNAE

(71) Applicant: Daniel R. Howell, Newburgh, IN (US)

(72) Inventor: Daniel R. Howell, Newburgh, IN (US)

(73) Assignee: Chronotrack Systems, Corp., Chanhassen, MN (US)

( * ) Notice: Subject to any disclaimer, the term of this patent is extended or adjusted under 35 U.S.C. 154(b) by 0 days.

(21) Appl. No.: 14/108,445

(22) Filed: Dec. 17, 2013

(65) Prior Publication Data

US 2014/0104046 A1 Apr. 17, 2014

Related U.S. Application Data

(63) Continuation-in-part of application No. 13/375,144, filed as application No. PCT/US2010/036674 on May 28, 2010.

(60) Provisional application No. 61/182,520, filed on May 29, 2009, provisional application No. 61/182,512, filed on May 29, 2009.

(51) Int. Cl.

| | |
|---|---|
| ***G04F 1/00*** | (2006.01) |
| ***G08B 1/08*** | (2006.01) |
| ***G06F 19/00*** | (2011.01) |
| ***A63B 71/06*** | (2006.01) |

(52) U.S. Cl.

CPC ..... *A63B 71/0686* (2013.01)
USPC ..... 702/178; 340/539.13; 700/91

(58) Field of Classification Search

USPC ..... 702/178, 57, 79, 127, 188–189; 343/700 R, 703, 718, 731, 757, 824, 343/874; 340/8.1, 323 R, 539.1, 539.11, 340/539.13, 573.1, 600; 700/91

See application file for complete search history.

(56) References Cited

U.S. PATENT DOCUMENTS

| | | | | |
|---|---|---|---|---|
| 5,812,049 | A | 9/1998 | Uzi | |
| 5,966,102 | A * | 10/1999 | Runyon | 343/820 |
| 7,327,251 | B2 | 2/2008 | Corbett, Jr. | |

(Continued)

FOREIGN PATENT DOCUMENTS

| | | | |
|---|---|---|---|
| DE | 10 2007 040 602 | A1 | 3/2009 |
| EP | 2381527 | A1 | 10/2011 |

(Continued)

OTHER PUBLICATIONS

Impinj, RFID Case Study: Los Angeles marathon, 2008, 4 pp.*

(Continued)

*Primary Examiner* — Toan Le
(74) *Attorney, Agent, or Firm* — C. Richard Martin

(57) ABSTRACT

An electronic timing system for timing of athletic events is provided. The timing system includes one or more vertically oriented radio-frequency identification reader assembly, a portable timing controller, a remote server, and a radio-frequency identification timing tag that is configured for attachment to an athlete. The vertically oriented radio-frequency identification reader includes an antenna assembly, a water-resistant radome surrounding the antenna assembly, and a tripod supporting the radome and antenna assembly. The portable timing controller includes one or more input/output devices, such as Ethernet or USB ports, for exchanging data with the radio-frequency identification antenna. The remote server also includes similar input/output devices for exchanging data with the input/output devices of the portable timing controller. The timing tag and antenna are configured for wirelessly communicating data between one another.

18 Claims, 9 Drawing Sheets

(56) References Cited

U.S. PATENT DOCUMENTS

| | | | |
|---|---|---|---|
| 7,455,217 | B2 | 11/2008 | Taylor et al. |
| 7,463,905 | B1 | 12/2008 | Smiley et al. |
| 2001/0054878 | A1 | 12/2001 | Odaohhara |
| 2004/0224135 | A1 | 11/2004 | Krebs |
| 2006/0097847 | A1 | 5/2006 | Beervoets et al. |
| 2006/0217232 | A1 | 9/2006 | Kondrat et al. |
| 2007/0135243 | A1 | 6/2007 | LaRue et al. |
| 2007/0213126 | A1 | 9/2007 | Deutsch et al. |
| 2008/0074954 | A1 | 3/2008 | Moritani |
| 2008/0146265 | A1 | 6/2008 | Valvani |
| 2008/0269017 | A1 | 10/2008 | Ungari |
| 2009/0188207 | A1 | 7/2009 | Gordin et al. |
| 2009/0303135 | A1 | 12/2009 | Reed et al. |
| 2010/0227659 | A1 | 9/2010 | Claver |
| 2010/0259365 | A1 | 10/2010 | Knadle, Jr. et al. |
| 2011/0227748 | A1 * | 9/2011 | Schaible et al. ..... 340/686.6 |

FOREIGN PATENT DOCUMENTS

| | | | |
|---|---|---|---|
| WO | WO2004104961 | A1 | 12/2004 |
| WO | WO2009011600 | A1 | 1/2009 |
| WO | WO2011047094 | A2 | 4/2011 |

OTHER PUBLICATIONS

Uddin et al., Design and Application of radio Frequency Identification Systems, 2009, European Journal of Scientific Research, vol. 33, No. 3, pp. 438-453.*

* cited by examiner

FIGURE 1
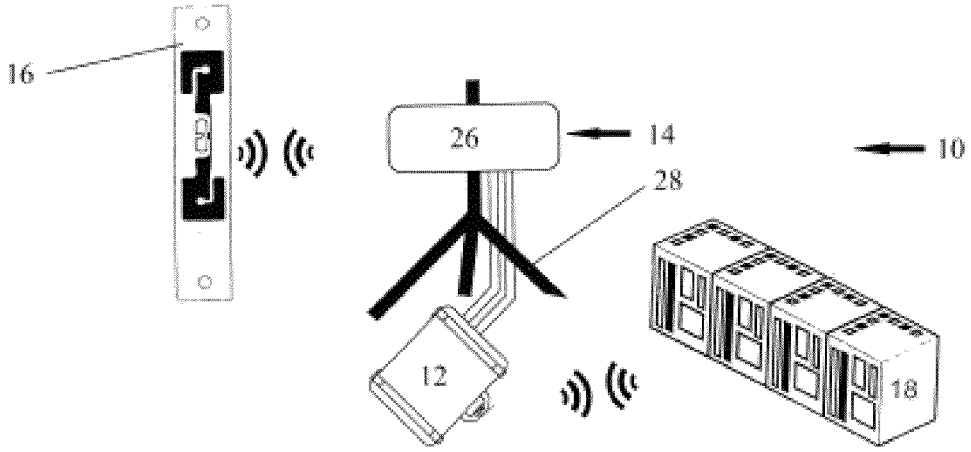
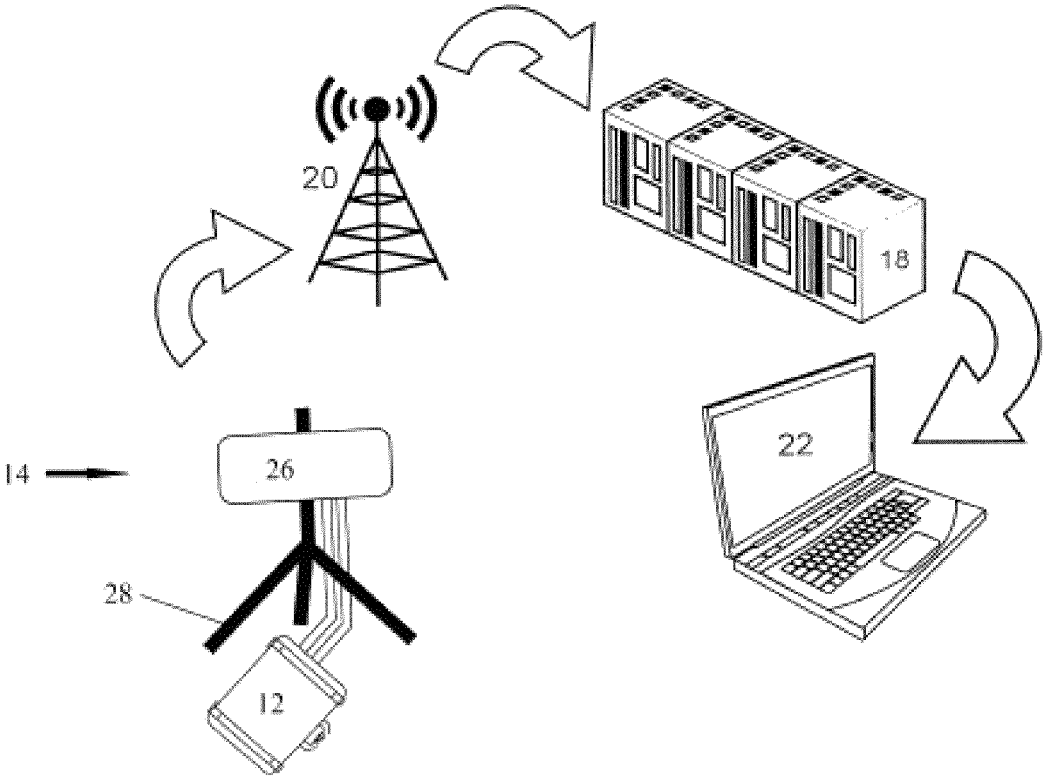
FIGURE 2

RACE TIMING SYSTEM WITH VERTICALLY POSITIONED ANTENNAE

CROSS REFERENCE TO RELATED PATENT APPLICATIONS

The present patent application is a continuation-in-part of U.S. patent application Ser. No. 13/375,144 filed Nov. 29, 2011, which was a National Stage entry under 35 U.S.C. §371 of International Patent Application Serial No. PCT/US2010/036674 filed May 28, 2010, which claims the benefit of U.S. Provisional Application Ser. No. 61/182,520 filed May 29, 2009 and U.S. Provisional Application Ser. No. 61/182,512 filed May 29, 2009.

FIELD OF THE INVENTION

The invention relates to electronic timing systems used for timing of endurance athletes competing in races, and specifically relates to an improved timing system utilizing a portable controller, a vertically oriented RFID antenna, a disposable UHF RFID tag that is attached to the athlete, and remote server software.

BACKGROUND OF THE INVENTION

The human spirit is competitive. Since earliest times, men and women have run and raced against each other. The basic race consists of a start where someone says "GO" and everyone races to the finish line—first one across wins. A stopwatch can be used to determine the winning time.

It is easy to spot the winners—they are at the front, but it is not so simple to determine who is, say "400$^{th}$". Today, every runner wants to know how he or she did compared to other runners and to their "personal best" time. They want to know if they are "400$^{th}$" or "401$^{st}$". To know that, an accurate, recorded time needs to be generated for every runner.

In a large race today, there are thousands of runners. Systems need to capture a start-time for every runner and to track when they cross the finish line, then use that data to compute that runner's elapsed time. In long races, runners also want to know what their "split times" are. They want to know what their times were when they crossed certain mile markers during the race. Further sophistication now requires that these times be posted on the internet in real time so that relatives and loved ones can use the runner's number to see when their runner passed these points.

Applicant's previously filed, co-pending international application serial number PCT/US10/36674 provides an improved UHF RFID timing system comprising an RFID antenna that is placed on the race course and connected to the portable controller via the cellular network. An RFID tag on the runner's shoe or bib communicates with the RFID antenna to transmit data on the runner to the portable controller. The RFID antenna is housed within a rubberized shell ("skin") that encases the antenna and allows the routing of cables to subsequent antennae in the line. The skin includes a central hollow section for receiving the RFID antenna and cabling for connecting the RFID antenna to the controller and/or to additional RFID antennae. Sloped side sections are connected to the lengthwise ends of the central section to create a gradual slope leading up to the raised center section. A hinged cover to the central section is provided to facilitate insertion of the RFID antenna and cabling. The dimensions of the skin and the slope of the end sections are designed to be ADA compliant, and preferably the skin is approximately 42" L×31.5" W and is 1" H at the central section. Each respective skin is configured to be interlockingly attached to another skin by projections that are provided in one end of each respective end section and corresponding indentations provided in the other end of each respective end section of the skin. The ends of multiple skins may be linked together form timing lines which are laid across the road for athletes to run over. As the athlete passes over the antenna in the skin, the tag on the athlete's shoe or bib is read.

One additional requirement for timing races is redundancy. There is only one opportunity to capture a runner's time, if a failure were to occur there must be redundant features of the system to overcome this failure and still capture a time. At the most important points in a race (especially the start and finish) two independent timing lines are laid down so that if one line were to fail the second line would capture the runners time. The two lines have traditionally been called the "Primary" and "Secondary" timing lines Up until now these lines had to be spaced at 15-20 feet apart so that the RFID components would not interfere with each other. However if a runner is missed at the primary line and subsequently detected at the secondary line the runner will have a second or two added to his/her time based on the time it takes to reach the secondary line. The current system requires the placement of the antennas over the road. Even though the skins are ADA compliant, they still create "speed bumps" for disabled athletes competing in wheel chairs and hand cracked cycles. These skins are heavy and it takes a certain amount of effort and time to lay out a timing line.

The present invention overcomes many of these limitations. Firstly it can be used in a "stand alone mode". That is, the present invention can be used in lieu of one of the above timing lines. The system can be quickly and easily set up by the side of a road without requiring a strip of antennas to be placed on the ground and in the roadway for athletes to pass over. Each timing location contains a pair of vertical antenna assemblies and control boxes that can be quickly and easily set up and taken down. The vertical orientation of the antennas also avoids the necessity of a skin being laid across the road for a runner to cross.

The present invention can also be used in conjunction with the previous system. The vertical antennas can be placed directly over the previously described timing line. Each system has its own controller, power supply, batteries etc. . . . In such a configuration total redundancy is achieved in that if any of the lines fail, the other will capture the runner's time. In this configuration the runner's time will be the same irrespective of what line captured the read so there is now no error when the runner's time is captured on the secondary line. In this combined configuration, the radiating pattern of the vertical antennae have been designed in such a way that they work synergistically with the horizontal antenna and do not interfere.

SUMMARY OF THE INVENTION

The present invention provides an all-weather option that is better suited to the logistics and pace of today's style of events. The present invention includes four primary components: the controller, a vertically oriented RFID antenna, the timing tag, and the remote server software.

According to one aspect of the present invention, there is provided an electronic timing system for timing of athletic events comprising a vertically oriented radio-frequency identification reader assembly, a portable timing controller, a remote server, and a radio-frequency identification timing tag that is configured for attachment to an athlete. The portable timing controller includes input/output means for exchanging data with the radio-frequency identification antenna. The remote server also includes input/output means for exchanging data with the input/output means of the portable timing controller. The timing tag and antenna include means for wirelessly communicating data between one another.

According to a presently preferred embodiment of the invention, the vertically oriented radio-frequency identification reader assembly includes an antenna assembly, a water-resistant radome surrounding the antenna assembly, and a tripod supporting the radome and antenna assembly. The antenna assembly further includes a two-element dual linear phased array antenna assembly, and a feed network disposed on a printed circuit board, a portal ground plane positioned between the antenna assembly and printed circuit board, and a pair of RF cables electrically connected to the feed network. The feed network is electrically coupled to the two-element dual linear phased array antenna assembly. The two-element dual linear phased array antenna assembly may include a pair of dual-feed U-shaped radiating elements according to one aspect of the invention. A plurality of spacers may also be positioned between the U-shaped radiating elements and the portal ground plane.

The U-shaped radiating elements and the portal ground plane are formed of a conductive material, which may be an anodized aluminum alloy such 5052-H32 aluminum.

According to a preferred embodiment, the portal ground plane is at least 57 cm in length and at least 21 cm in width. The radome may be formed of a durable acrylic-pvc alloy such as KYDEX®.

According to yet a further aspect of the present invention, a back lobe suppressor may be provided. The back lobe suppressor may have a front face positioned adjacent a rear surface of the antenna assembly. The front face of the back lobe suppressor is preferably formed out of a radiant barrier material such as aluminum or stainless steel, or out of a metallic mesh material, preferably copper mesh.

According to one aspect of the invention, a pair of vertically oriented radio-frequency identification reader assemblies are positioned on opposing sides of a race path. A portable timing controller may be associated with each one of the pair of vertically oriented radio-frequency identification reader assemblies. A horizontally oriented radio-frequency identification reader assembly extending across the race path may also be provided. The horizontally oriented radio-frequency identification reader assembly is also associated with its own corresponding portable timing controller. The pair of vertically oriented radio-frequency identification reader assemblies may be positioned twenty-eight feet or less from one another across the race path.

Accordingly, it is an object of the present invention to provide a low cost, portable, configurable timing system that eliminates the strips of skins housing antennas to be laid across a racecourse. It is a further object of the invention to provide a portable timing system having vertically oriented antennas that can be quickly and easily set up and taken down along the racecourse.

These and other objects, features and advantages of the present invention will become apparent with reference to the text and the drawings of this application.

BRIEF DESCRIPTION OF THE DRAWINGS

FIG. 1 is a schematic diagram showing the primary components of the present invention according to a presently preferred embodiment as used in conjunction with an improved race timing system.

FIG. 2 is schematic diagram showing the primary components of the present invention according to a presently preferred embodiment used in conjunction with an alternative improved race timing system.

DETAILED DESCRIPTION OF PREFERRED EMBODIMENTS

Figure 3:
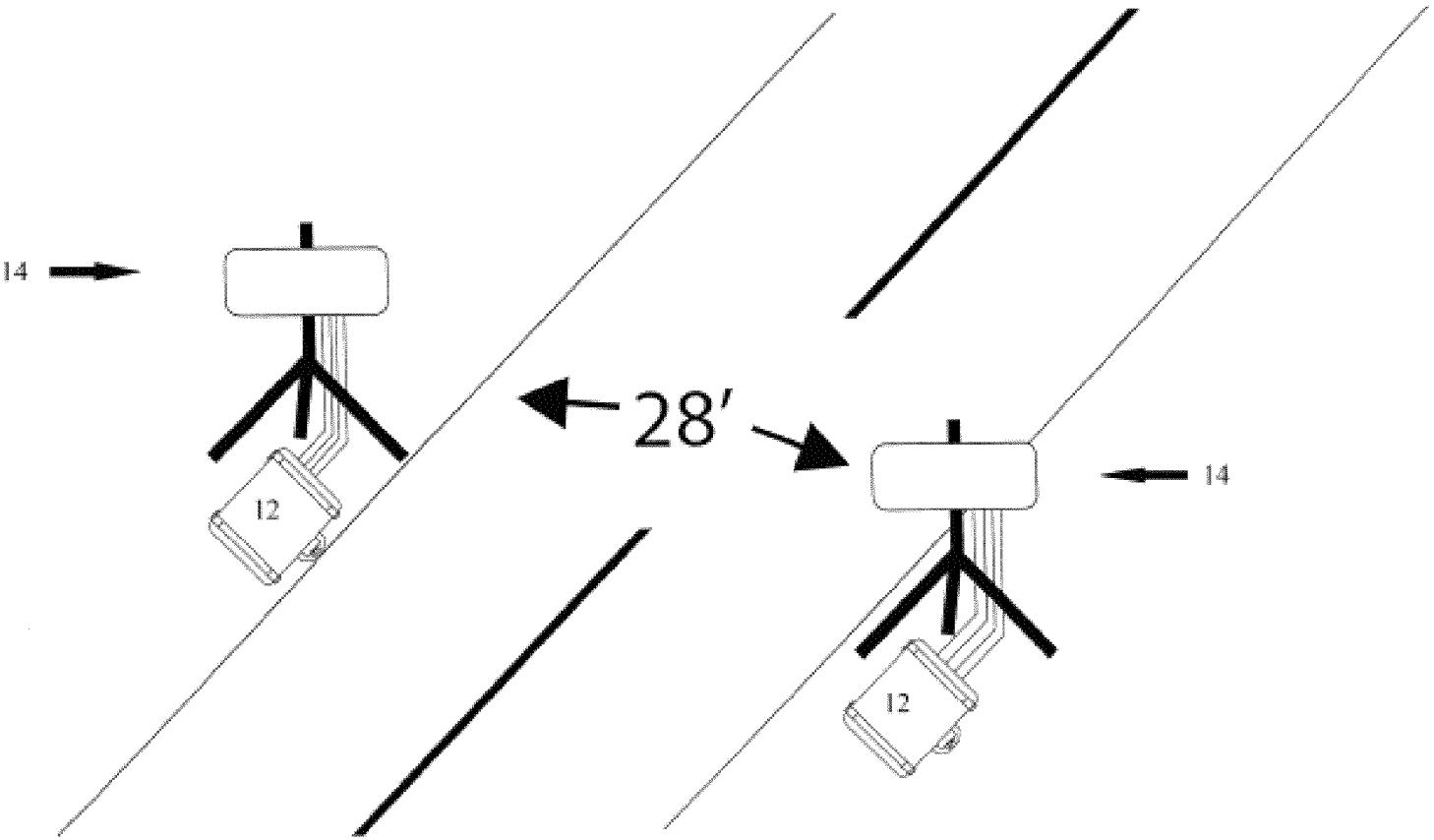
FIG. 3 is a perspective view one presently preferred embodiment of the present invention having of a pair of vertically oriented antennae and controllers positioned along a racecourse.

The present invention is a race timing system 10 incorporating one or more vertically oriented reader assemblies 14. As shown in FIG. 1, the timing system 10 includes four primary components: a controller 12, a vertically oriented RFID reader assembly 14, a timing tag 16, and a remote server 18. The remote server 18 and associated software collects timing data from any race point where a vertically oriented RFID reader assembly 14 and controller 12 are located using several different methodologies and delivers this data to the timer so that he/she can quickly and efficiently score the race. FIG. 2 depicts how timing data collected from the vertically oriented RFID reader assembly 14 is passed to the controller 12, which in turn sends it to the remote system server 18 via a communication link using, for example a cell phone tower 20. The system server 18 formats and filters this data and delivers it to the timers scoring package, via any accessible internet link. This enables timers to score races remotely—that is, they use non-skilled employees to lay out the timing equipment at the race site and, using the GPRS cell capabilities built into or attached to each controller 12, the data is sent to the timer who scores the race from their office or mobile timing center and using a laptop computer 22 with printer attached (not shown) that prints the results in situ or sends them remotely to the race site.

According to a presently preferred embodiment of the invention, the vertically oriented RFID reader assembly 14 includes an antenna assembly 24 enclosed in a water resistant radome 26 which, in turn, is mounted on a tripod 28. Each antenna assembly 24 consists of a two-element dual linear phased array antenna assembly, which includes two U-shaped radiating elements 30*a*, 30*b*, a small ground plane 32, a feed network on a printed circuit board (PCB) 34, and at least two RF cables 35*a*, 35*b* connected to the PCB which in turn creates the phased array vertically polarized signals which are fed to the respective radiating elements 30*a*, 30*b*. The antenna assembly can be potentially used in applications that require wide coverage and superior antenna gain. According to one presently preferred embodiment of the invention, the antenna assembly 24 is a SPEEDWAY® xPortal RFID Reader, as is known in the art, turned on its side such that what would normally be the horizontally polarized array is now the vertically polarized array. In the present invention, only the now vertically polarized array need be utilized.

Figure 4:
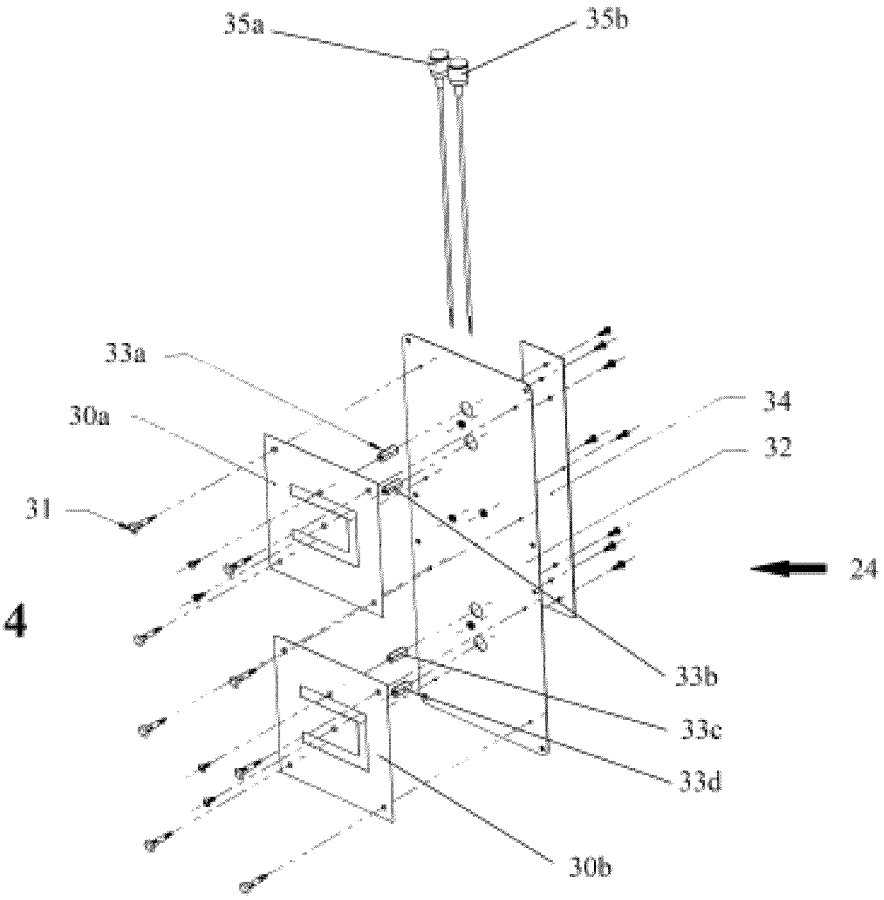
FIG. 4 is an exploded perspective view of the antenna assembly according to a presently preferred embodiment.
Figure 5:
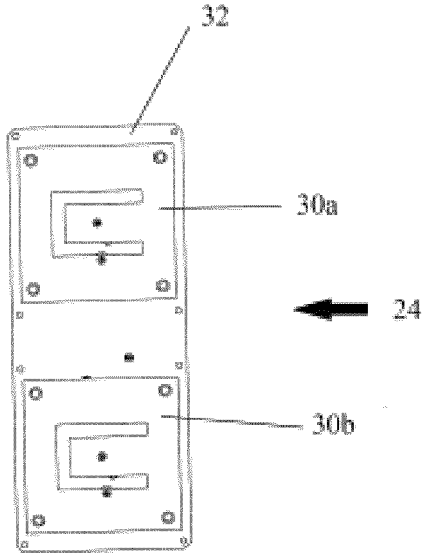
FIG. 5 is a front view in elevation of the antenna assembly shown in FIG. 4.

As best shown in FIGS. 4 & 5, the antenna assembly 24 includes a pair of dual feed U-shaped radiating elements 30*a*, 30*b*, mounted on a portal ground plane 32. A plurality of spacers 31 are used to offset the radiating elements 30*a*, 30*b* from the portal ground plane 32. The radiating elements 30*a*, 30*b* and ground plane 32 may be formed of any suitable conductive material. According to one preferred aspect of the invention, the radiating elements 30*a*, 30*b* and ground plane 32 are formed from an anodized aluminum alloy such as 5052-H32 aluminum. The ground plane 32 needs to be large enough to work properly, otherwise the ground currents will cause undesirable radiation and the antenna will become very RF sensitive. According to a presently preferred embodiment of the invention, the minimum size of the ground plane is required to be 57 cm×21 cm. Pairs of standoffs 33*a*, 33*b* and 33*c*, 33*d* connect the radiating elements 30*a*, 30*b*, respectively, to the PCB 34.

Figure 6:
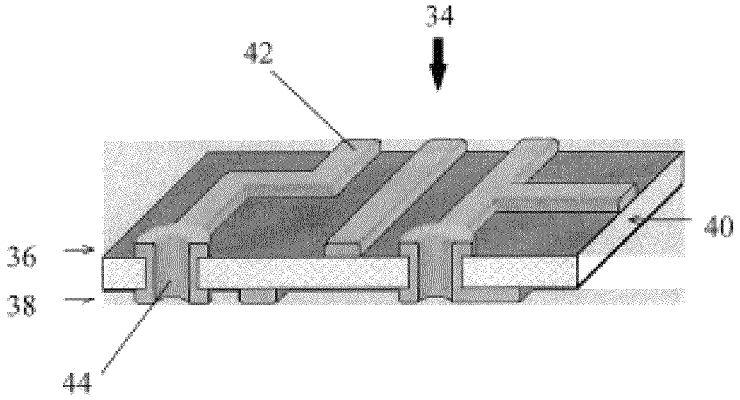
FIG. 6 is a perspective view of the printed circuit board (PCB) of the antenna assembly shown in FIG. 4.

As shown in FIG. 6, the PCB 34 consists of a top layer 36 and a bottom layer 38 surrounding a core 40. The top layer 36 and bottom layer 38 are formed from a high performance epoxy laminate, preferably FR-406, with a preferred dielectric constant of 4.8. The thickness of the PCB 34 is preferably approximately 0.062 inches. The conductors 42 on the top layer 36 and bottom layer 38 are plated to 1.5 oz. minimum, with a conductive material, preferably copper. All holes 44 in the PCB 34 are plated through as shown in FIG. 6. The top layer 36 and bottom layer 38 are preferably finished with a solder mask over bare copper (SMOBC).

The radome 26 may be formed from a durable acrylic polyvinyl chloride (pvc) alloy, such as KYDEX® or a material having similar RF characteristics. The impedance of the antenna 24 must be tuned to the specific radome 26. If the antenna 24 is taken outside of the radome 26, or a vastly different radome material is used, the antenna impedance will be detuned resulting in poor performance. Accordingly, other materials having dissimilar RF characteristics from acrylic-polyvinyl chloride alloys such as KYDEX® may be used, but only if the impedance of the antenna 24 is tuned for that specific material.

Figure 7:
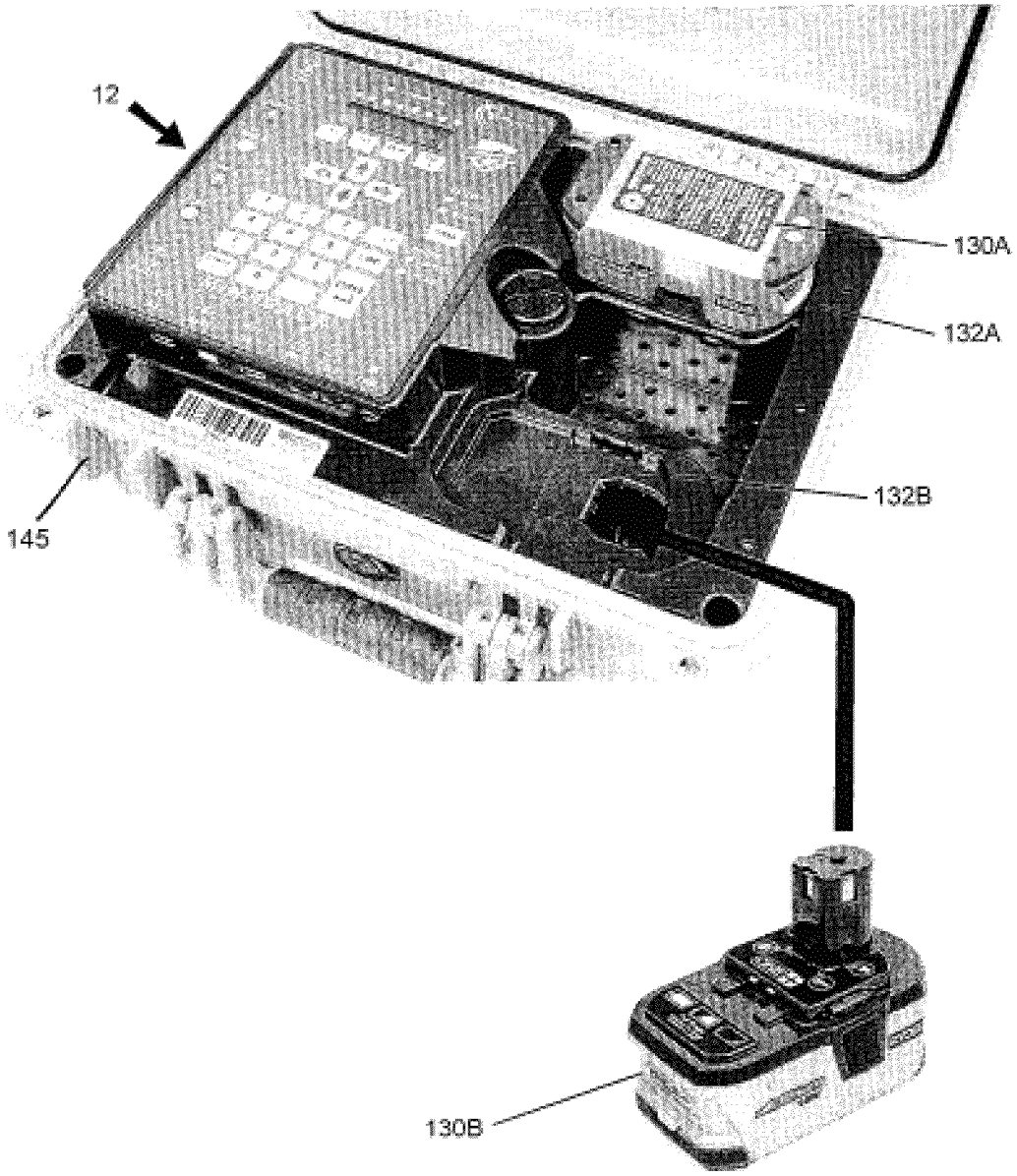
FIG. 7 is a perspective view of a controller for the improved timing system of the present invention according to one presently preferred embodiment of the invention.
Figure 8:
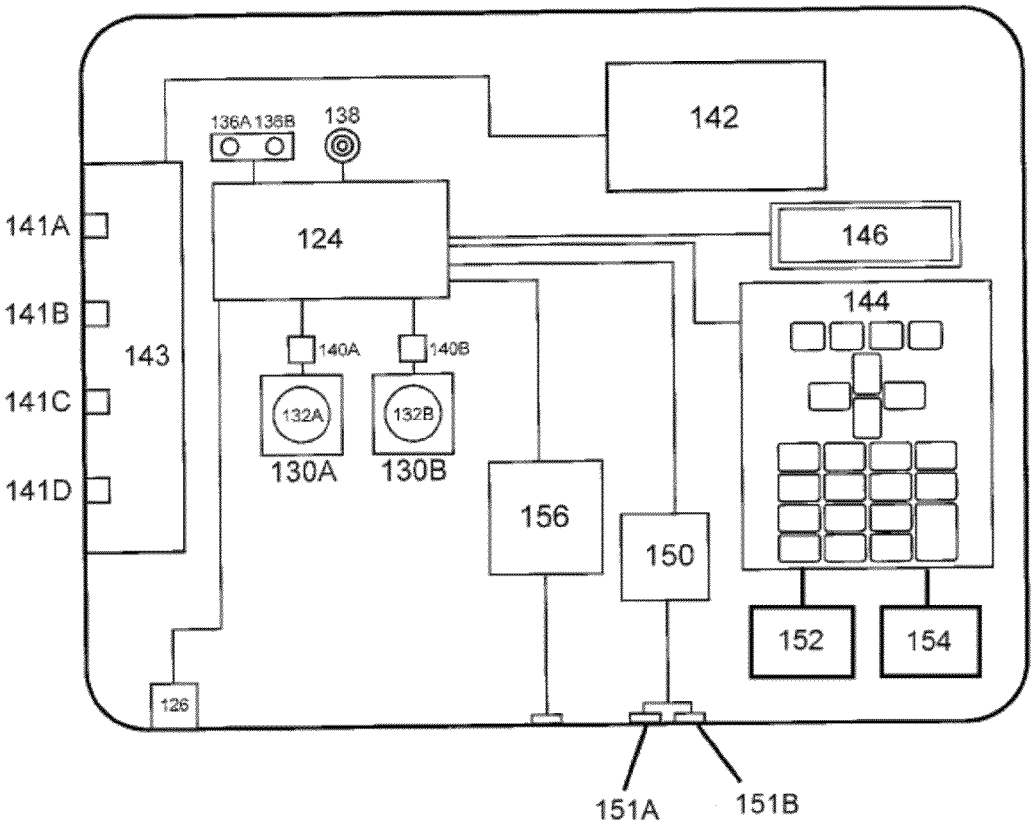
FIG. 8 is a schematic view of the controller of FIG. 7.

As shown in FIG. 3, the antenna 24 is connected to a timing controller box 12, which remains on the ground next to the tripod 28. As shown in FIG. 7 and FIG. 8, the controller 12 is a self-contained mobile Gen2 UHF RFID reader system and includes intelligent power management in the form of a power control board 124 that will accept and manage electrical power from multiple sources, including 110-220 volt AC 126, and removable batteries 130*a*, 130*b*. The power control board 124 also drives one or more LEDs 136*a*, 136*b* to indicate battery levels and further sounds an audible alarm 138 when the power level is critically low. Each battery 130*a*, 130*b* also contains its own power management board 140*a*, 140*b*, respectively, that prevents the batteries 130*a*, 130*b* from being overcharged or damaged by being fully discharged or short circuited.

Internally, the controller 12 utilizes a self-contained mobile Gen2 UHF RFID reader 142. This reader may be standard off-the-shelf RFID readers such as the SPEEDWAY® Revolution RFID Reader manufactured by Impinj, Inc., and is capable of reading 650 RFID tags per second. A proprietary application has been embedded onto the reader to filter the enormous amount of data it is capable of collecting and further to format and present the data in such a fashion that it can be used in a timing environment. The RFID antenna ports 141*a*-141*d* from the reader 142 are piped to the output mesa 143 on the controller 12 where quick connect connectors are used to connect the feed cables 36*a*-36*d* to the ports 141*a*-141*d*, respectively, of the controller 12.

The controller 12 utilizes a a pressure sensitive membrane (keypad) 144 in conjunction with a LCD display 146 to configure the RFID reader and to manage and configure input out devices used to convey the timing data to the timing server 18 or directly to the timer's laptop. The controller 12 utilizes multiple I/O methodologies and devices including Ethernet, external cellular modems, external WiFi and USB ports to communicate data. The controller 12 has a built in Ethernet hub 150 with two external Ethernet ports 151*a*, 151*b*. The RFID reader 142 is IP addressable and can be configured using the keypad 144 and LCD display 146. The Ethernet ports 151*a*, 151*b* can be used to attach the controller 12 to any network following the appropriate configuration steps. The controller 12 can be connected to the server 18 by using third party GPRS routers such as a Cradlepoint 350 and either a AT&T or Verizon compatible modems. The Cradlepoint router is attached to the controller via Ethernet using the built in Ethernet ports 151*a* or 151*b*. As shown in FIG. 2, this modem is used to send timing data to a system server 18 from remote locations where it is not feasible to use Ethernet or WiFi. The controller 12 can also utilize 802.11 a/b/g wireless radio (WiFi) by attaching a third party WiFi device one of the Ethernet ports 151*a* or 151*b*. The traditional use such a device is to allow a timer to wirelessly communicate to a controller 12 from his or her laptop computer 22. Finally, timing data can be manually removed from the controller plugging USB memory sticks into one or more USB ports 156 built into the controller 12. USB memory sticks can also be used to load application upgrades to the RFID reader 142. The controller components are housed in a portable carry case 145 that can be equipped with a handle to aid in carrying. It is understood that alternative controllers, for example the controllers described in applicant's co-pending international application serial no. PCT/US10/36674, can be utilized in connection with the present invention without departing from the scope or spirit of the invention.

Each controller 12 and antenna assembly 14 can monitor a 14 ft section of road. Any distance in excess of 14 ft requires a system on each side of the road, as shown in FIG. 3. The controllers 12 and antenna assemblies 14 have been designed so they can be positioned directly opposite each other without creating interference.

Figure 9:
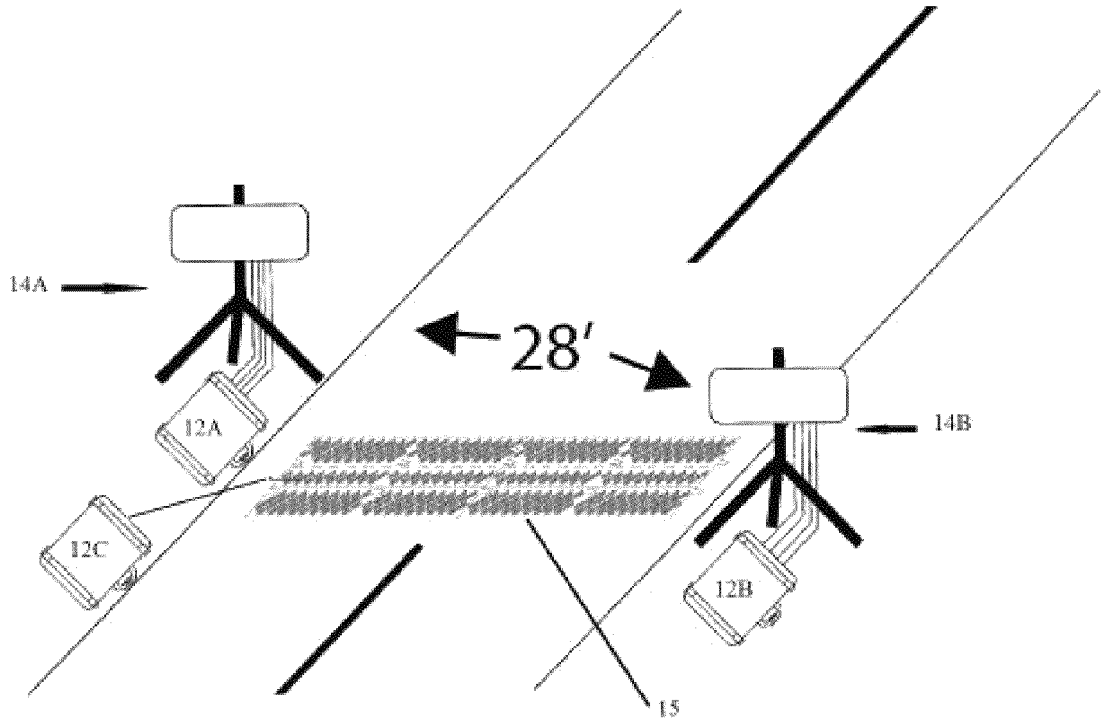
FIG. 9 is a perspective view of an alternate preferred embodiment of the present invention having a horizontally oriented antenna and a pair of vertically oriented antennae and controllers positioned along a racecourse.

According to an alternative embodiment shown in FIG. 9, a race timing system 10 is provided incorporating one or more vertically oriented reader assemblies 14*a*, 14*b* and a horizontally oriented reader assembly 15. Each of the reader assemblies 14*a*, 14*b*, 15 is connected to a controller 12, as shown in FIG. 9. Alternatively, two or more of the reader assemblies can be connected to a single controller.

Figure 10:
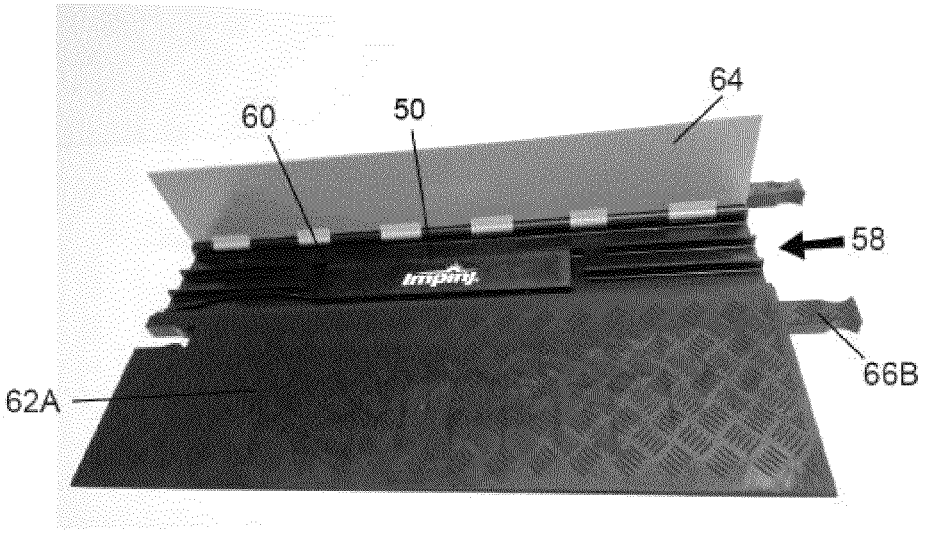
FIG. 10 is a perspective view of a horizontally oriented reader and antenna assembly according to one presently preferred embodiment of the present invention.

The horizontally oriented reader 15 is configured as described in applicant's co-pending international application serial no. PCT/US10/36674, and as shown in FIG. 10, wherein an RFID antenna 50 is housed within a rubberized shell ("skin") 58 that encases the antenna 50 and allows the routing of cables to subsequent antennae 50*b*, 50*c*, . . . in the line. The antenna 50 is tuned to only operate correctly when inserted into the skin 58, and the reader 142 will not recognize that an antenna is attached when it is not properly inserted in the skin 58. The skin 58 includes a central hollow section 60 for receiving the RFID antenna 50 and cabling for connecting the RFID antenna 50 to the controller and/or to additional RFID antennae. Sloped side sections 62*a*, 62*b* are connected to the lengthwise ends of the central section 60 to create a gradual slope leading up to the raised center section 60. A hinged cover 64 to the central section 60 is provided to facilitate insertion of the RFID antenna 50 and cabling. The dimensions of the skin 58 and the slope of the end sections 62*a*, 62*b* are designed to be ADA compliant, and preferably the skin 58 is approximately 42" L×31.5"W and is 1" H at the central section 60. Each respective skin (e.g. 58*a*) is configured to be interlockingly attached to another skin (e.g. 58*b*) by projections 66*a*, 66*b* that are provided in one end of each respective end section 62*a*, 62*b* and corresponding indentations 68*a*, 68*b* provided in the other end of each respective end section 62*a*, 62*b* of the skin 58. The ends of multiple skins may be linked together form timing lines as shown in FIG. 9. These lines, when connected to a controller 12, can detect when timing tags 16 cross them and assign a time to when this event occurs. One controller 12 can support a line from 42 inches (a single RFID antenna 50 and skin 58) to 28 feet (eight RFID antennae and skins).

Figure 11:
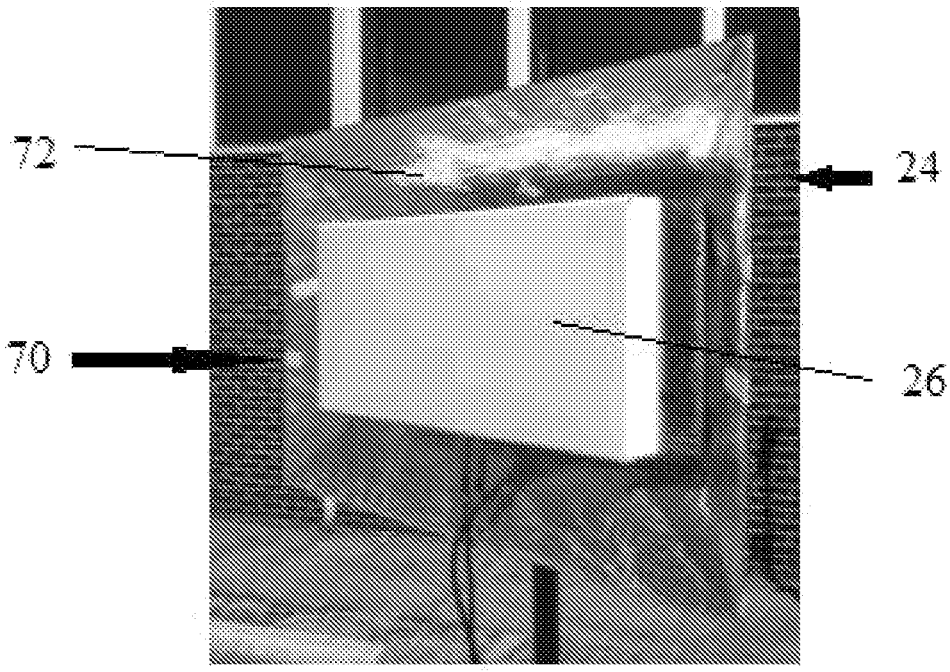
FIG. 11 is a photograph in perspective of a horizontally oriented antenna assembly according to an alternate preferred embodiment depicting a back lobe suppressor used in conjunction with the antenna.

After testing of the antenna assembly 24 it was discovered that the use of vertical antennas resulted in the creation of a significant back lobe from the rear face of the antenna 24 facing away from the racecourse. As a result, the antenna assembly could also obtain readings from tags located off the racecourse. This is particular problematic at the start and finish lines where runners may be milling about in the vicinity of the antenna assemblies while not actively participating in the event. In order to prevent such errant readings, the antenna assembly 24 may be fitted with a back lobe suppressor 70 as best shown in FIG. 11. The back lobe suppressor 70 has a front face 72 that faces the antenna assembly, and a rear face facing away therefrom. The front face 72 is formed out of a radiant barrier material such as aluminum or stainless steel, or, in the alternative, can be made from a metallic mesh material, preferably copper mesh. The rear face of the back lobe suppressor can be fabricated from any available material, and may even be the reverse side of the same material forming the front face 72. The front face 72 of the back lobe suppressor 70 is preferably separated a distance from the back side of the antenna assembly 24. One or more standoffs may be placed between the antenna assembly 24 and the back lobe suppressor 70 to achieve the desired separation. Use of a back lobe suppressor in this manner reduces the detection area behind the antenna from 10-15 feet to a mere 2 feet, which for application purposes is manageable. According to one preferred embodiment, the back lobe suppressor 70 is stamped from sheet metal into the shape depicted in FIG. 11.

The foregoing is provided for purposes of illustrating, explaining, and describing embodiments of the present invention. The specific components and order of the steps listed above, while preferred is not necessarily required. Further modifications and adaptation to these embodiments will be apparent to those skilled in the art and may be made without departing from the scope or spirit of the invention.

I claim:

1. An electronic timing system for timing of athletic events comprising:

a vertically oriented radio-frequency identification reader assembly;

a portable timing controller having input/output means for exchanging data with said radio-frequency identification reader assembly;

a remote server having input/output means for exchanging data with said input/output means of the portable timing controller; and a radio-frequency identification timing tag that is configured for attachment to an athlete, said timing tag and said radio-frequency identification reader assembly having means for wirelessly communicating data between one another.

2. The electronic timing systems according to claim 1, wherein the vertically oriented radio-frequency identification reader assembly comprises:

an antenna assembly;

a water-resistant radome surrounding said antenna assembly; and a tripod supporting said radome and antenna assembly.

3. The electronic timing system according to claim 2, wherein the antenna assembly comprises:

a two-element dual linear phased array antenna assembly;

a feed network disposed on a printed circuit board, said feed network being electrically coupled to said two-element dual linear phased array antenna assembly;

a portal ground plane positioned between said antenna assembly and said printed circuit board; and a pair of RF cables electrically connected to the feed network.

4. The electronic timing system according to claim 3, wherein the two-element dual linear phased array antenna assembly comprises a pair of dual-feed U-shaped radiating elements.

5. The electronic timing system according to claim 4, further comprising a plurality of spacers positioned between the U-shaped radiating elements and the portal ground plane.

6. The electronic timing system according to claim 5, wherein the U-shaped radiating elements and the portal ground plane are formed of a conductive material.

7. The electronic timing system according to claim 6, wherein the U-shaped radiating elements and the portal ground plane are formed of anodized aluminum alloy.

8. The electronic timing system according to claim 2, wherein the radome is formed of a durable acrylic polyvinyl chloride alloy.

9. The electronic timing system according to claim 2, further comprising a back lobe suppressor having a front face positioned adjacent a rear surface of the antenna assembly.

10. The electronic timing system according to claim 9, wherein the front face of the back lobe suppressor is formed out of a radiant barrier material.

11. The electronic timing system according to claim 10, wherein the radiant barrier material is selected from a group consisting of aluminum and stainless steel.

12. The electronic timing system according to claim 9, wherein the front face of the back lobe suppressor is formed out of a metallic mesh material.

13. The electronic timing system according to claim 12, wherein the metallic mesh material is copper mesh.

14. The electronic timing system according to claim 3, wherein the portal ground plane is at least 57 cm in length and at least 21 cm in width.

15. The electronic timing system according to claim 1, further comprising a pair of vertically oriented radio-frequency identification reader assemblies positioned on opposing sides of a race path.

16. The electronic timing system according to claim 15, further comprising a portable timing controller associated with each one of said pair of vertically oriented radio-frequency identification reader assemblies.

17. The electronic timing system according to claim 16, further comprising a horizontally oriented radio-frequency identification reader assembly extending across the race path, said horizontally oriented radio-frequency identification reader assembly having a corresponding portable timing controller associated therewith.

18. The electronic timing system according to claim 15, wherein the pair of vertically oriented radio-frequency identification reader assemblies are positioned twenty-eight feet or less from one another.

* * * * *